US007517226B2

(12) United States Patent
Kawam et al.

(10) Patent No.: US 7,517,226 B2
(45) Date of Patent: Apr. 14, 2009

(54) HELICAL CONTACT CONNECTOR SYSTEM

(76) Inventors: Eli Kawam, Northrop Grumman Electro Optical Systems, 1215 S. 52nd St., Tempe, AZ (US) 85281; Jon P. Martin, Northrop Grumman Electro Optical Systems, 3414 Herrmann Dr., Garland, TX (US) 75041-6188; Terry D. Morris, Northrop Grumman Electro Optical Systems, 1215 S. 52nd St., Tempe, AZ (US) 85281

( * ) Notice: Subject to any disclaimer, the term of this patent is extended or adjusted under 35 U.S.C. 154(b) by 0 days.

(21) Appl. No.: 11/829,065

(22) Filed: Jul. 26, 2007

(65) Prior Publication Data

US 2009/0029580 A1 Jan. 29, 2009

(51) Int. Cl.
*H01R 12/00* (2006.01)

(52) U.S. Cl. ..... 439/66; 439/930; 439/788

(58) Field of Classification Search ..... 439/66, 439/788, 840, 825, 866, 930
See application file for complete search history.

(56) References Cited

U.S. PATENT DOCUMENTS 3,255,430 A * 6/1966 Phillips ..... 439/786
3,281,751 A * 10/1966 Blair ..... 439/75
4,358,180 A * 11/1982 Lincoln ..... 439/695
4,437,726 A 3/1984 Lambert
4,797,113 A 1/1989 Lambert
4,842,536 A 6/1989 Meyrat et al.
5,051,108 A * 9/1991 Lincoln ..... 439/825
5,943,174 A 8/1999 Bryant et al.
6,077,128 A 6/2000 Maag et al.
6,288,386 B1 9/2001 Bowen et al.
7,249,981 B2 * 7/2007 Chen ..... 439/751
2004/0023530 A1 * 2/2004 Garcia ..... 439/75

* cited by examiner

*Primary Examiner*—Tho D Ta
(74) *Attorney, Agent, or Firm*—Marsteller & Associates, P.C.

(57) ABSTRACT

A connector system (C) for forming an electrical connection between two electronic or electrical assemblies includes a conductive tubular female member (40) and a compatible flexible male member (44). The male member (44) preferably comprises a helical coil spring-like wire portion (50) about a central axial post (52) for establishing electrical contact with and removably mating with an interior surface (42) of the conductive tubule receptacle member (40) electrically connected with an electronic assembly (28).

12 Claims, 7 Drawing Sheets

HELICAL CONTACT CONNECTOR SYSTEM

BACKGROUND OF THE INVENTION

1. Technical Field

The invention relates to the field of electrical interconnection systems, and more particularly to connector systems for connecting printed wiring boards, flexible cable assemblies and wires to any other printed wiring boards, flexible cable assemblies and wires.

2. Background Art

Connection systems for connecting printed wiring boards, flexible cable assembly and wires with other related or associated electronic circuitry are well known in the art. For example, see U.S. Pat. Nos. 4,437,726, 4,797,113, 4,820,536, 4,842,536, and 6,077,128.

Known, commercially available connector systems that may have been applicable to flex cable assemblies typically consisted of 3 pieces and rely on a simple pin that plugs into a receptacle mounted with the image intensifier tube and associated power supply that derives its retentive and contact force by employing multiple leaf springs arranged around the internal circumference of the tube housing. An example of such connector is product numbers 0673 and 0508 by Mil-Max Manufacturing Corp. of Oyster Bay, N.Y. In contrast to such known connector assemblies, the present connector assembly utilizes a 2 piece assembly that consists of a simple tubule housing mounted with the image intensifier housing and a resilient pin such as a "TEK PIN" that provides both the retentive and contact forces.

Flexible cable connection systems joining an image intensifier tube with other related or associated electronic circuitry are well known in the image intensifier tube art. For example, see U.S. Pat. Nos. 6,288,386 and 5,943,174 that describe two such flexible printed circuit board (PCB) cables 25 mounted to the image intensifier tube body 22 at one end and including a distal end having a four male-type pin connector for connection with associated circuitry in a night vision device.

Typically the prior flexible connection systems were hard soldered into or otherwise permanently connected to the power supply circuitry and extended outside of the image intensifier tube packaging or housing.

While the above cited references introduce and disclose a number of noteworthy advances and technological improvements within the art, none completely fulfills the specific objectives achieved by this invention.

DISCLOSURE OF INVENTION

In accordance with the present invention, a removable electrical assembly includes a flexible electrically conductive male pin member for establishing electrical contact with and removably mating with the interior surface of a conductive tubule female member that is electrically connected with another electrical assembly. The male pin member is comprised of a helical coil spring-like wire portion formed about a central axial post.

Further, a removable electrical cable assembly for forming an electrical connection with a power supply module for an image intensifier tube unit includes a flexible electrical conductive member having a first end and a distal end. The first end has at least one first male pin member for establishing electrical contact with and removably mating with an interior void of a conductive tubule member electrically connected with the power supply module. The distal end is adapted to mate with at least one compatible connector associated with electronic circuitry external to the image intensifier tube. The first pin member preferably comprises a helical coil spring-like wire portion formed about a central axial post.

These and other objects, advantages and preferred features of this invention will be apparent from the following description taken with reference to the accompanying drawings, wherein is shown the preferred embodiments of the invention.

BRIEF DESCRIPTION OF DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

In FIG. 11*a*, a pair of TEKPINs 44 are part of a second assembly 32 aligned for insertion into a pair of tubule receptacles 40 attached as part of a first assembly 28. In FIG. 11*b*, the TEKPINs are partially inserted. In FIG. 11*c*, the TEKPINs are fully inserted with the first assembly mounted flush with the second assembly.

MODE(S) FOR CARRYING OUT THE INVENTION

Figure 1:
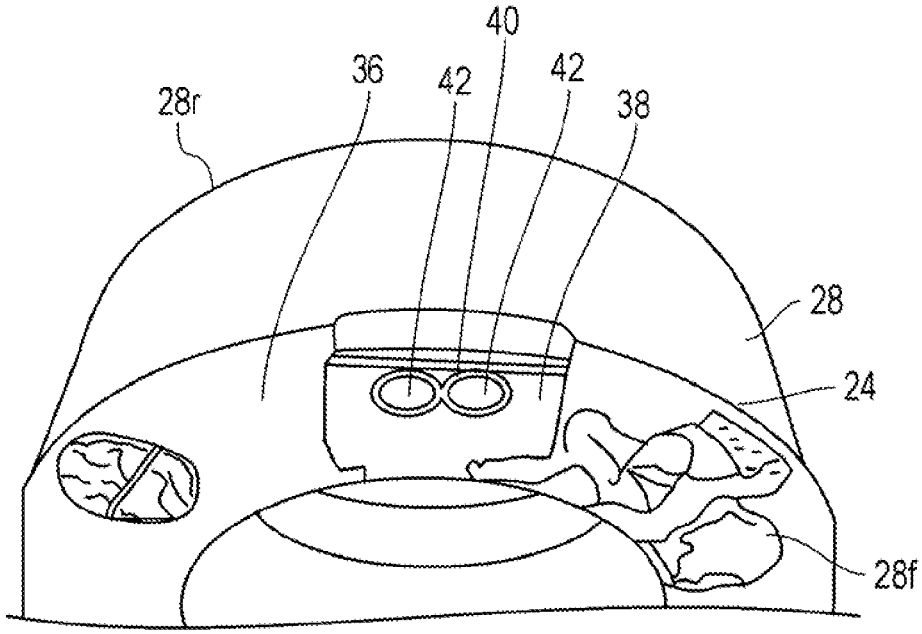
FIG. 1 is a perspective view of an electronic assembly depicting a pair of tubule receptacles.
Figure 2:
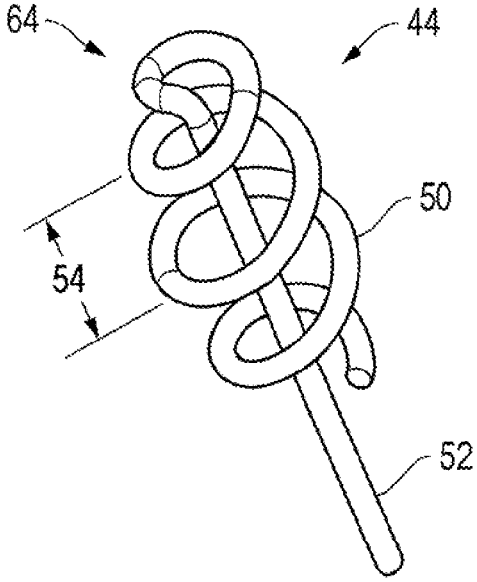
FIG. 2 is a front isometric view of a second embodiment of the spring contact of the present invention.
Figure 3:
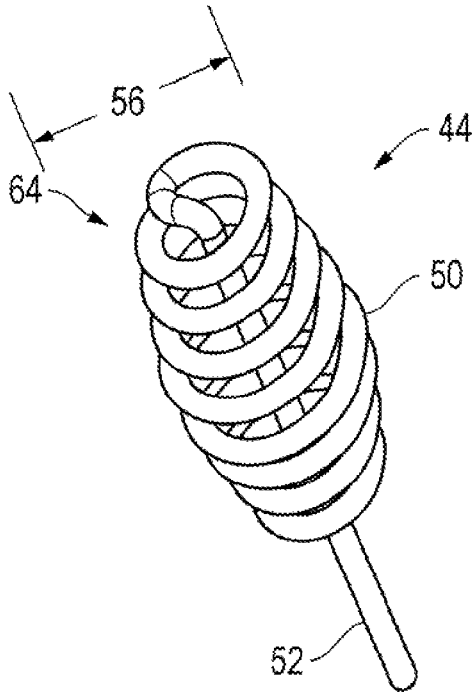
FIG. 3 is a front isometric view of a second embodiment of the spring contact of the present invention.
Figure 4:
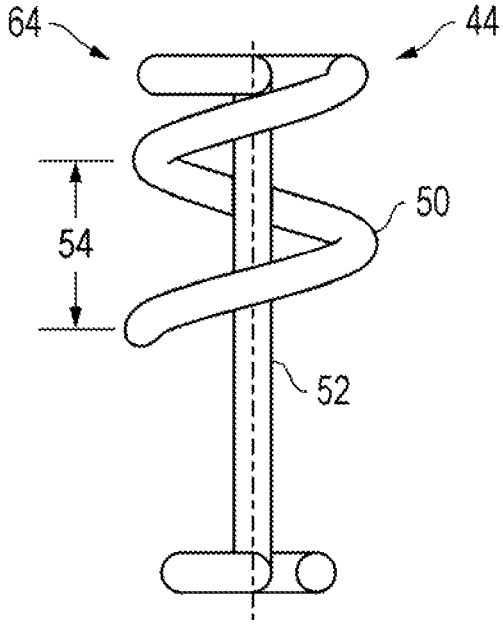
FIG. 4 is a side elevational view of the spring contact of FIG. 1.
Figure 5:
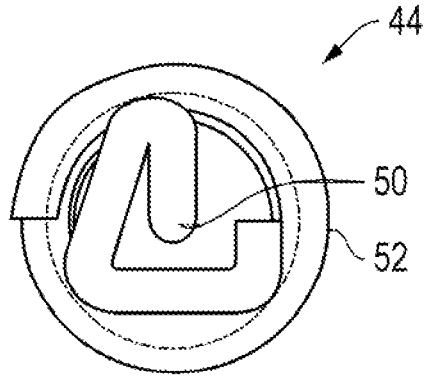
FIG. 5 is a bottom plan view of the spring contact of FIG. 2.
Figure 6:
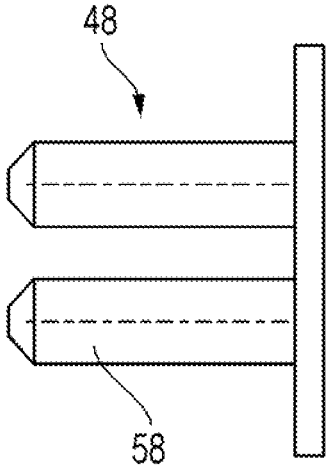
FIG. 6 is a front elevation of an elastomeric plug.
Figure 7:
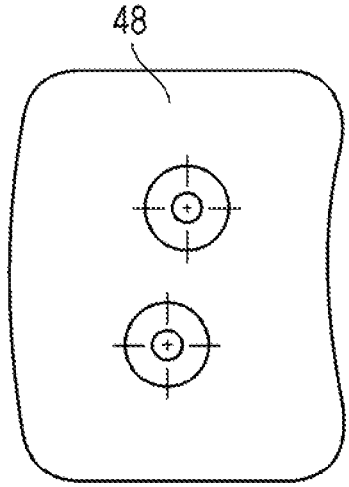
FIG. 7 is a plan view of an elastomeric plug.

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

The present helical coil connector assembly system C includes a removable electrical assembly 32 having a first end 34. The first end 34 has at least one first male pin member 44 for establishing electrical contact with and removably mating with an interior surface 42 of a conductive tubule member 40 electrically connected with a second electrical assembly 28. The first pin member 44 preferably comprises a helical coil spring-like wire portion 50 formed about a central axial post 52.

FIG. 1 depicts a known electrical assembly 28. A second electrical assembly 32 is connected to the electrical assembly 28 for desired and known electrical and electronic functions.

The present second electrical assembly 32 can be unplugged from electrical assembly 28 for desired and known electrical and electronic functions.

The components of the present connector system C generally include at least one tubular receptacle 40 mounted with the desired electrical assembly 28 that provides corresponding recesses or cavities 42 into which the front end of the specially designed connector pin 44, which may also be called the TEKPIN, attached to and electrically connected to the second electrical assembly 32 can fit.

The tubular receptacle 40 itself consists of an electrically conductive, preferably a pure metallic tubule 40 that may be optionally plated with a solder-able material that can be surface mounted to a circuit by standard pick and place equipment that is used industry wide.

As known to those skilled in the art, an alternative receptacle for the TEKPIN could be a suitable plated thru holes (PTH) in a printed wiring board or other assembly, or a suitable diameter hole in any material that can be preferentially plated or processed for electrical contact means as described herein. Furthermore, alternative interconnect means may be accomplished using the TEKPIN invention, including co-axial connections, and in-line multi-contact connections. As is known to those skilled in the art, co-axial connectors (commonly known as RCA, BNC, or "F" connectors) typically possess a solid center pin and a circular outer contact. By replacing the solid center pin with a TEKPIN, all the attendant advantages of a tubular receptacle described herein may be obtained. In addition, an in-line multi-contact connector (commonly known as an ⅛" stereo headphone plug) may be implemented with 2 or more TEKPIN contacts, formed as circumferential connectors arranged in an axial configuration.

FIGS. 2-5 and 12 show the complementary male type TEKPIN 44 that is shaped to be inserted within the void 42 of a tubule 40 and may be preferably formed having a helical coil spring portion 50 wound around an axial center post 52. The spring portion 50 may optionally be formed having a variable pitch 54 and variable diameter 56. The pin 44 is formed from electrically conductive material having a desired resilience to permit multiple insertions and removals of the pins 44 from the tubules 40. As is known to those skilled in the art, this material may be beryllium copper, shape memory metal of various alloys, commonly known as NiTiNOL, piano wire, stainless steel, or any material that is or can be electrically conductive and can be formed into the preferred helical spring shape, as described herein. The TEKPIN 44 may be optionally plated with a solder-able material that can be soldered to the second electrical assembly 32 in either a surface mount or through hole configuration.

Such a TEKPIN 44 itself using a spring of the demonstrated shape to provide contact and retentive forces in an electrical connector system is a novel use of what appears to be a simple mechanical component.

The tubule 40 itself provides a distinct advantage when used in electronic devices that are to be encapsulated, such as high-voltage image intensifier power supplies, using anyone of a class of materials commonly referred to as potting compounds which are designed to flow into minute spaces within an electronic device. The advantage is simply that the smooth inner surface of the tubule provides a simple geometry which allows the insertion and extraction of an elastomeric sealing plug before and after encapsulation. The varying diameters of more common receptacles and the presence of the leaf springs are difficult to seal and are rendered unreliable when the potting compound penetrates the receptacle and prevents the spring action, thereby rendering the electrical circuit incomplete or intermittent. Other alternative connector systems use a receptacle design in which the springs are fully exposed rendering them impossible to seal.

The elastomeric plug 48 has been designed so that it will compress during the insertion into the interior cavity 42 of the tubule 40, and relax after insertion to provide intimate contact with the interior tubule walls and surface of the plugs 58. The material selected for the plug 48 is selected so that potting compound being used will not adhere to it. The plug 48 can be optionally designed to fit into multiple tubules 40 and accommodate a large degree of misalignment of the tubules 40.

Figure 14:
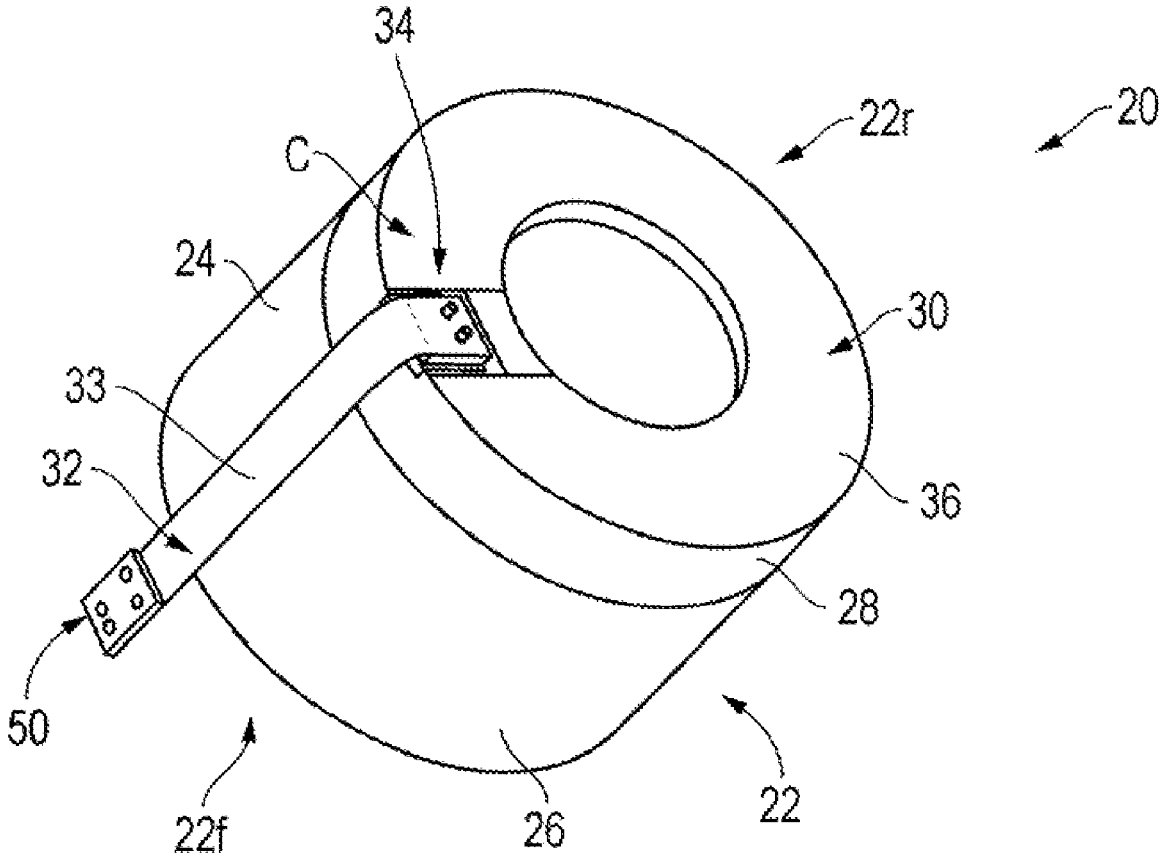
FIG. 14 is a front isomeric view of an image intensifier power supply unit having a flexible tail connector strip unit installed.

Referring particularly to FIG. 14, an exemplary use for the present invention includes a known image intensifier tube unit 20 of the type that is suitable for use in a night vision device or the like includes an image tube housing 22 having, for purposes of explanation and example, a front side **22*f*, a rear side 22*r*, and a generally cylindrical exterior surface 24. The image intensifier tube unit generally includes the image intensifier tube 26 with associated power supply comprising the electronic assembly 28 and an optional rear cover 30. A flexible cable or tail assembly 32 is used to electrically connect the image intensifier tube unit 20** to associated circuitry (not shown) for desired and known electrical and electronic functions.

The present flex cable assembly 32 can be unplugged from an image intensifier associated power supply 28 to allow conversion from one model of image intensifier tube to another after the image intensification tube assembly is completed. Thus, the flex cable assembly 32 can be used to change the basic characteristics of the power supply module 28 and can be used to covert or adapt a night vision device from using a single image intensifier tube type to using other image intensifier tube types.

The power supply end 34 of the flex cable assembly 32 is preferably flush to, or approximately even with, the top surface 36 of the power supply 28 or the optional rear cover 30 and occupies no more space than the design used in known products. An indentation or groove 38 may be formed in the rear end **22*r* of the power supply housing 28, when the potting operation is performed with the elastomeric plug 48 installed, to receive the end 34 of the flex cable 32**.

The components of the image intensifier exemplary system generally include at least one tubular receptacle 40 mounted with the image intensifier housing 22. This provides corresponding recesses or cavities 42 into which a complementary TEKPIN connector 44 attached to and electrically connected with the head of the flex cable assembly 32 can fit. The specially designed connector pin 44, which may also be called the "TEKPIN," is mounted with or attached to the power supply end 34 of the flex cable assembly 32 to extend an electrical conduit or circuit. A flexible electrical conduit or a flexible printed circuit board (PCB) extends and electrically connects the power supply end 34 with the opposite or distal end 35. An optional slit 46 may be formed in the power supply end 34 of the flex tail cable 32 such that the power supply end 34 can desirably accommodate a large degree of misalignment of the tubules 40. A removable elastomeric plug 48 may be used to seal the voids 42 of the tubules 40 during the manufacturing process.

The complementary image intensifier housing end 34 of the connector assembly 32 itself consists of an electrically conductive, preferably thin walled tubule 40 that may be optionally plated with a solderable material that can be surface mounted to a circuit by standard pick and place equipment that is used industry wide.

The compatible elastomeric plug 48 may be designed to mimic the shape of the power supply end 34 of the flex cable 32 in order that it may form a pocket 38 in the potting compound into which the end of the flex tail may fit once the plug is removed.

The flex cable assembly 32 is optionally split at end 34 and may also optionally be reinforced with a layer 60 of Kaptan® or other suitable stiffening or supportive material to allow misalignment while remaining rigid enough to provide strength for insertion and extraction of the pins when the cable 32 is unplugged.

The distal end 35 of the flex cable assembly 32 generally includes one or more male type pin members 45 to provide power to the image intensifier tube or other desired electrical functions. The head or distal end 35 may also optionally be formed including further electrical components such as resistors, transistors, and the like, forming a part of a flexible PCB 33.

Figure 8:
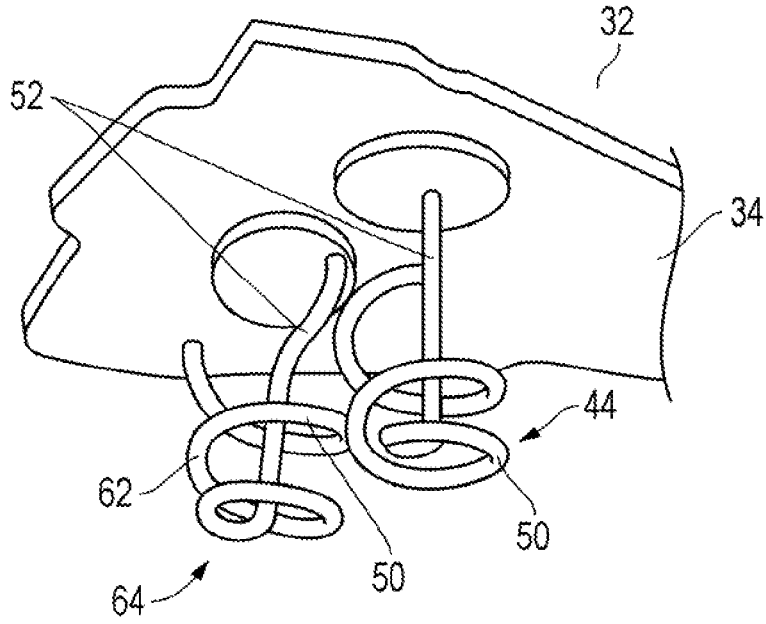
FIG. 8 is an isomeric view of one end of a flexible cable circuit assembly with pins installed.
Figure 9:
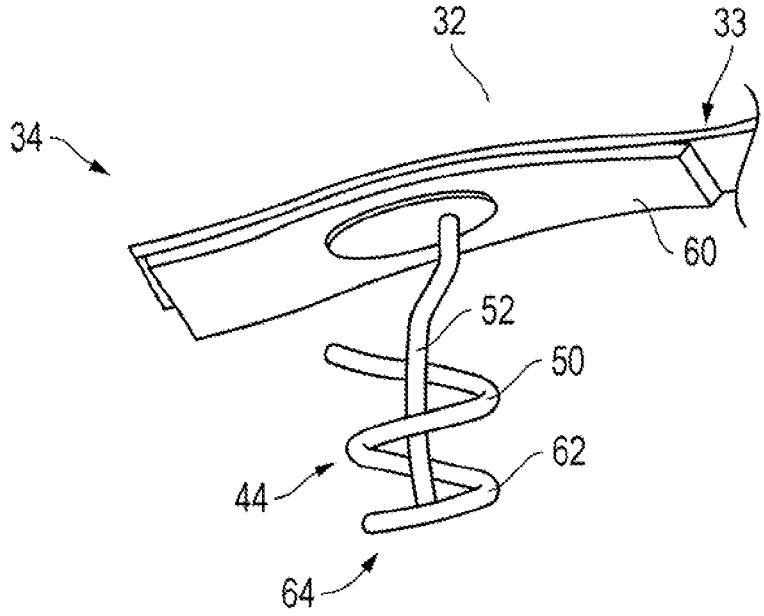
FIG. 9 is a side elevational view of the flexible cable circuit assembly of FIG. 8 with pin installed.
Figure 10:
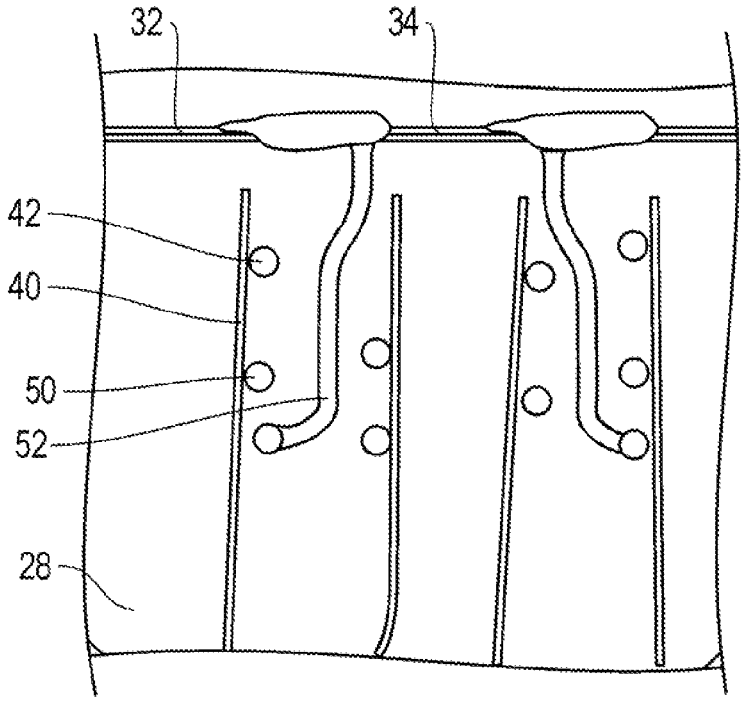
FIG. 10 depicts a cross-section view of a mated pair of TEKPINs and tubule receptacles. For clarity, the assembly has been vacuum potted and then sectioned and polished.
Figure 11A:
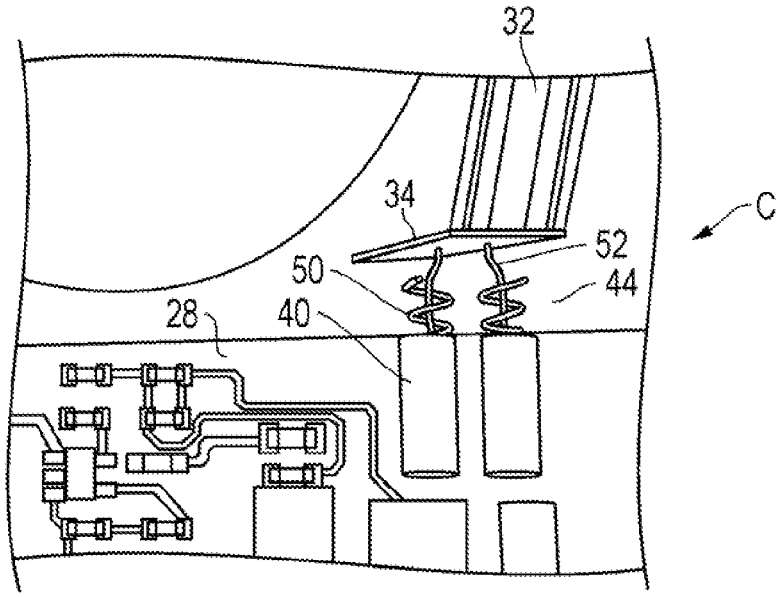
FIGS. 11*a*, 11*b* and 11*c* are plan views of the preferred embodiment.
Figure 11B:
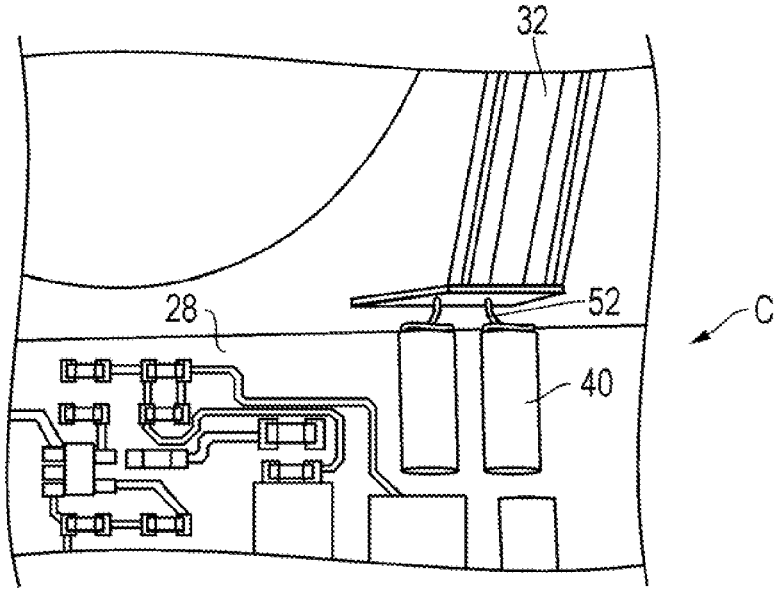
Figure 11C:
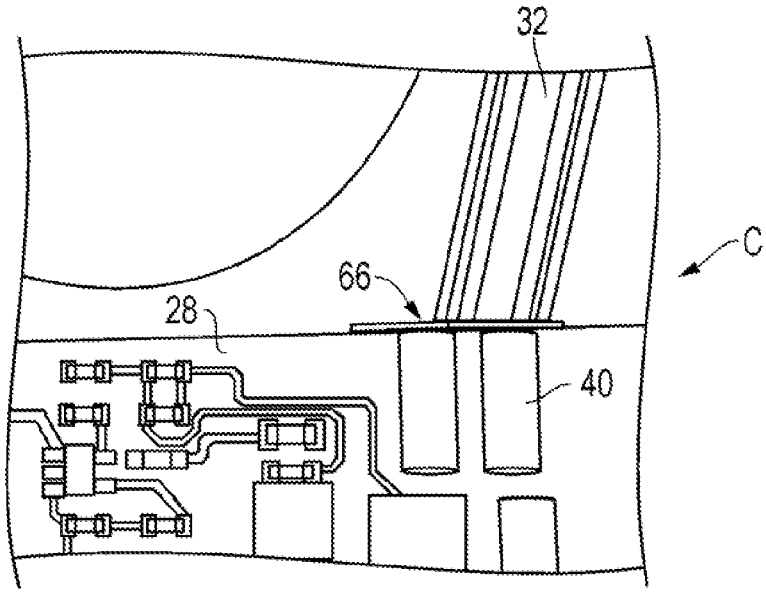
Figure 12:
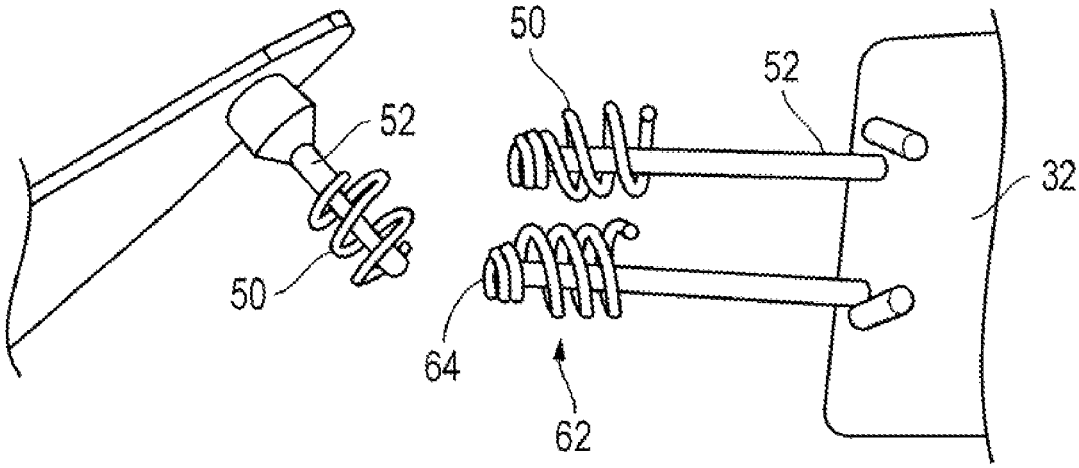
FIG. 12 is a front isomeric view of a third embodiment of the spring contact of the present invention wherein the center shaft 52 and coil spring 50 are joined to provide the same functionality as illustrated in FIGS. 2 and 3.
Figure 13:
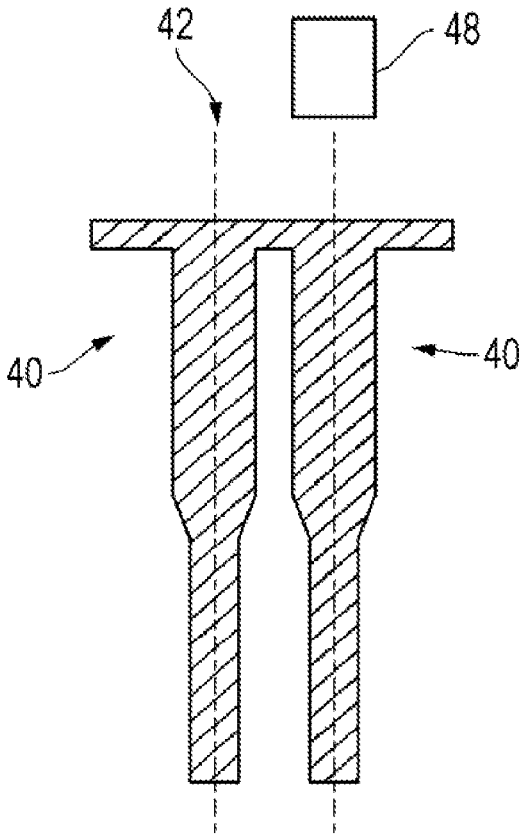
FIG. 13 is a side elevational view of an elastomeric plug.

With reference to FIGS. 8 and 12, an optional metallic conductive coating or member 62 is formed on or about an end or top 64 of the pin 44 to improve the electrical contact between the tip 64 of the pin 44 and the inner wall 66 of the tubule connector member 40.

In general, a method for providing an electrical connection two electronic or electrical assemblies, such as by way of example a power supply module for an image intensifier tube unit, comprising the steps of:

(a) at least one electrically conductive female-type tubule member being electrically connected with an electrical or electronics assembly;

(b) at least one electrical conductive male-type pin member having a first end and a distal end being electrically connected with an electrical or electronics assembly; and, (c) establishing electrical contact between a first end of the electrical conductive pin member with and removably mating with an interior void of a conductive tubule member, whereby the electrical contact between the tubule member and the male pin member is maintained through the deformation of the coil spring element and the elastic properties of the material of the coil spring element.

The electrical contact that may be interrupted by withdrawing the TEKPIN member from the conductive tubule member through the resilience of the coil spring and the elastic properties of its material.

The distal end of the electrical conductive member may be adapted for mating with at least one compatible connector associated with electronic circuitry external to the image intensifier tube unit.

The foregoing disclosure and description of the invention are illustrative and explanatory thereof, and various changes in the size, shape and materials, as well as in the details of the illustrated construction may be made without departing from the spirit of the invention.

The invention claimed is:

1. A connection system for establishing electrical contact between two electrical or electronic assemblies comprising:

at least one electrically conductive female-type tubule member electrically connected with a first electrical assembly; the tubule member having an interior void;

at least one complementary first male pin member electrically connected with a second electrical assembly; the first male pin member including a helical coil spring-like portion formed about a central shaft for establishing electrical contact with the tubule member and being adapted for removably inserting into the interior void of the electrically conductive female-type tubule member in which interior void the helical coil spring-like portion establishes the electrical contact with the electrically conductive female-type tubule member; and further including an electrically conductive member having a first end and a distal end; the first male pin member being mounted with the first end of the electrically conductive member; and, the distal end of the electrically conductive member being adapted to mate with at least one compatible connector associated with the second electrical assembly for establishing electrical conductivity, whereby electrical contact between the first and second electrical assemblies may be interrupted by withdrawing the helical coil spring-like portion of the first male pin member from the conductive tubule member, and electrical contact between the first and second electrical assemblies may be maintained through resilience of the coil spring portion and elastic properties of material comprising the helical coil spring-like portion of the male pin member.

2. The invention of claim 1 wherein the helical coil spring-like portion of the male pin member is formed about a central axial post member.

3. The invention of claim 1 wherein the helical coil spring-like portion of the male pin member is formed having a variable diameter along a longitudinal axis and is suitable for mating with a corresponding tubule.

4. The invention of claim 1 wherein the helical coil spring-like portion of the male pin member is formed having a variable pitch along a longitudinal axis and is suitable for mating with a corresponding tubule.

5. The invention of claim 1 wherein the first electrical assembly is a power supply module for an image intensifier tube unit.

6. The invention of claim 1 wherein the electrical conductive member is formed with a flexible printed circuit board (PCB).

7. A method for connecting two electrical assemblies comprising:

electrically connecting at least one electrically conductive female-type type tubule member with a first electrical assembly; and, further including an electrically conductive member having a first end and a distal end; the first male pin member being mounted with the first end of the electrically conductive member; and, the distal end of the electrically conductive member being adapted to mate with at least one compatible connector associated with the second electrical assembly for establishing electrical conductivity;

electrically connecting at least one electrically conductive male-type pin member with a second electrical assembly; the first male pin member including a helical coil spring-like portion formed about a central shaft for establishing electrical contact with the tubule member and being adapted for removably inserting into an interior void of the electrically conductive female-type tubule member; and, establishing electrical contact between a first end of the electrical conductive pin member with the electrically conductive female-type tubule member in the interior void and removably mating with the interior void of the electrically conductive female-type tubule member;

whereby electrical contact between the first and second electrical assemblies may be interrupted by withdrawing the helical coil spring-like portion of the first ale pin member from the conductive tubule member, and electrical contact between the first and second electrical assemblies may be maintained through resilience of the coil spring portion and elastic properties of material comprising the soil spring portion of the male pin member.

8. The method of claim 7 wherein the helical coil spring-like portion of the male pin member is formed about a central axis post member.

9. The method of claim 7 wherein the helical coil spring-like portion of the male pin member is formed having a variable diameter along a longitudinal axis and is suitable for mating with a corresponding tubule.

10. The method of claim 7 wherein the helical coil spring-like portion of the male pin member is formed having a variable pitch along a longitudinal axis and is suitable for mating with a corresponding tubule.

11. The method of claim 7 wherein the first electrical assembly is a power supply module for an image intensifier tube unit.

12. The method of claim 7 wherein the electrical conductive member is formed with a flexible printed circuit board (PCB).

* * * * *